United States Patent [19]

Koltse

[11] 4,196,083

[45] Apr. 1, 1980

[54] APPARATUS AND METHOD FOR CONTINUOUS PLATING BATH TREATMENT SYSTEM

[76] Inventor: John G. Koltse, 2939 N. Oakley, Chicago, Ill. 60648

[21] Appl. No.: 915,782

[22] Filed: Jun. 15, 1978

Related U.S. Application Data

[63] Continuation-in-part of Ser. No. 785,832, Apr. 8, 1977, Pat. No. 4,133,757, which is a continuation-in-part of Ser. No. 705,796, Jul. 16, 1976, abandoned.

[51] Int. Cl.[2] ..... B01D 29/02

[52] U.S. Cl. ..... 210/193; 210/387

[58] Field of Search ..... 210/67, 387, 193, 75

[56] References Cited

U.S. PATENT DOCUMENTS

| | | | |
|---|---|---|---|
| 2,738,880 | 3/1956 | Whitney | 210/193 |
| 3,403,784 | 10/1968 | Blumberg | 210/67 |
| 3,864,266 | 2/1975 | Dietrick | 210/387 X |

*Primary Examiner*—John Adee

*Attorney, Agent, or Firm*—Alter and Weiss

[57] ABSTRACT

A continuous plating bath treatment system directs contaminated plating solution through a specially prepared filter medium and returns the filtered solution to service. The filter medium is a calendered polyester material provided in continuous roll form and is automatically replaced at regular intervals. As a new filter medium segment is drawn into position, a layer of carbon is deposited thereon to provide a chemical filtering element, thus providing chemical and mechanical filtration. Carbon is supplied from a supply hopper by vibrators; adjusting the rate at which vibration occurs conveniently allows adjustment of the volumetric flow of carbon. A support platform is included to hold the filter medium in a substantially horizontal orientation to receive the additional filter material. A reel mechanism collects spent segments of filter medium for ease of disposal or possible recycling.

4 Claims, 12 Drawing Figures

FIG.1
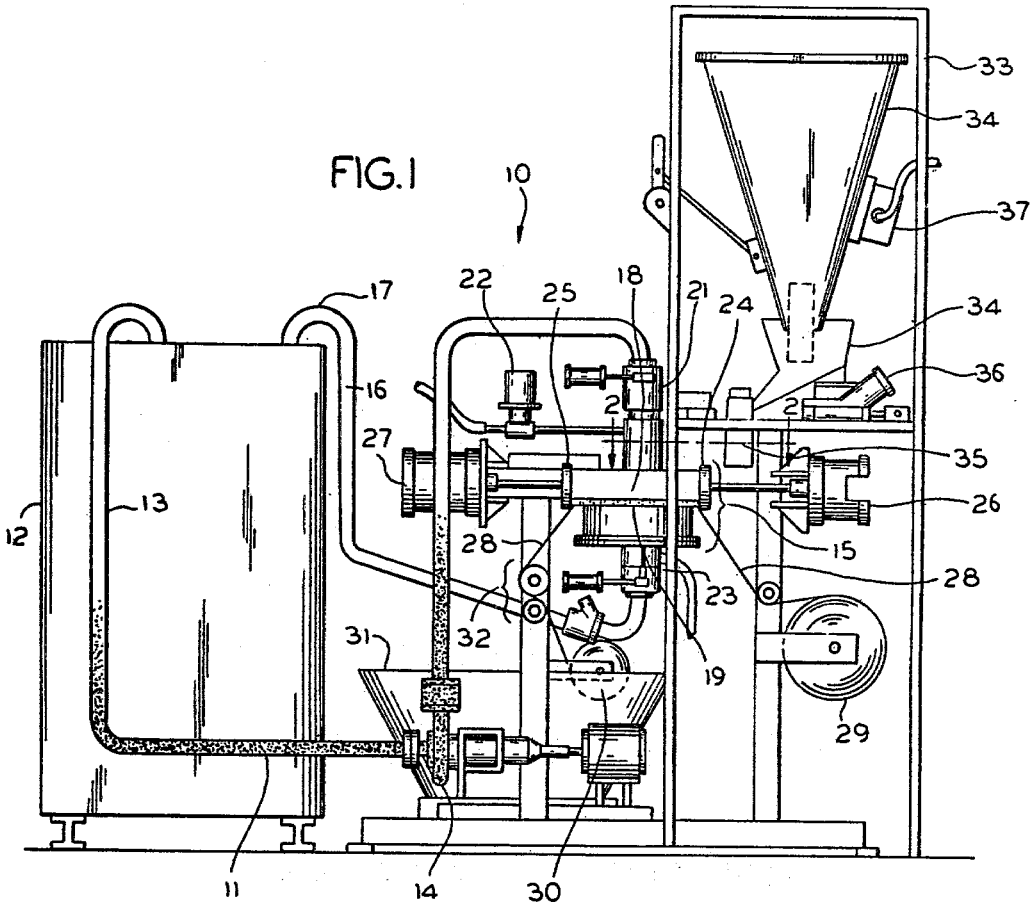
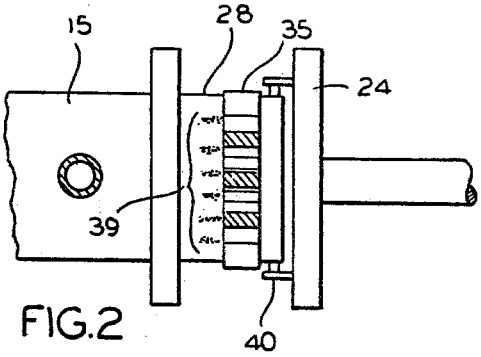
FIG.2
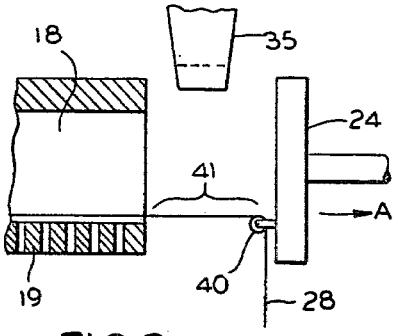
FIG.3
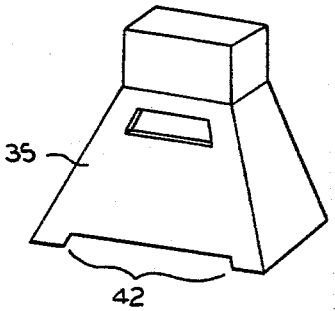
FIG.4
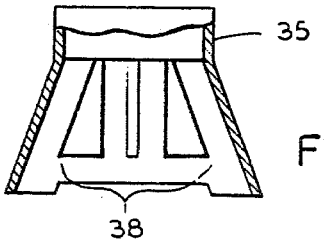
FIG.5

APPARATUS AND METHOD FOR CONTINUOUS PLATING BATH TREATMENT SYSTEM

This is a continuation-in-part of my U.S. Pat. No. 4,133,757 application Ser. No. 785,832, filed on Apr. 8, 1977, which is a continuation-in-part of my application Ser. No. 705,796, filed on July 16, 1976, and since abandoned.

This invention relates generally to continuous filtering systems and more particularly to methods and apparatus for continuously filtering acidic solutions used in electroplating processes.

Continuous filtering of solutions used during electrochemical processing converts an essentially batch process into a continuous process by eliminating the need to suspend operations while the process liquid is filtered and returned to the reaction vessel. Continuous filtration also assures a more constant and controllable concentration of contaminants in the liquid, rather than providing a process during which the fluid becomes progressively more contaminated until it can be no longer be used without filtration.

Continuous filtration apparatus, such as that described in U.S. Pat. No. 3,403,784, allows continuous filtration of a process liquid. As described therein, a paper filter medium, furnished in roll form, is extended across a perforated platen through which the liquid to be filtered is passed. As the filter medium approaches saturation, the flow of liquid may be temporarily interrupted to allow a fresh segment of filter medium to be advanced into position on the platen.

While this has provided adequate results for those liquids requiring only mechanical filtration, it has been less successful where a second filtering material is needed to effect adequate clarification of the filtrate and to effect chemical as well as mechanical filtration. One such additional filtering element is finely divided carbon. Use of carbon with automatic filtering equipment has, however, presented significant problems. Carbon is insoluble and must often be maintained in as finely powdered a texture as possible to present a maximum surface area available for filtration. The combination of these two factors presents significant material handling difficulties. To maximize filtration, the selected filter medium must be furnished with an adequate amount of carbon; to maximize the efficiency of the automatic filter system, carbon must be furnished on an automatic basis compatible with the operation of the filter mechanism.

Several approaches have been taken to solve this carbon handling and supply difficulty. In one approach, the filter medium is impregnated with carbon and carbon is thus present when the medium is indexed in position to begin filtration. Preparation of such impregnated filter medium is, however, expensive, and to date has produced unsatisfactory results in terms of even distribution of the carbon in the filter medium and contact time with the process liquid. Because various filtering operations may call for differing carbon requirements, a user may have to stock filter media of several different carbon concentrations, resulting in expensive inventory requirements, and substantial downtime when rolls of filter medium must be changed.

Another approach has been to include a slurry tank in the filtration process, within which a suspension of carbon particles in liquid is maintained. As the unfiltered solution is pumped into the filter, liquid from the slurry tank is mixed with it. The mixture of unfiltered solution and slurry then reaches the filter medium, at which point the carbon together with impurities in the unfiltered solution is trapped on the filter medium. This approach necessarily requires maintaining an adequate supply of slurry composition, and an adequate liquid level in the slurry tank, and again detracts from the efficiency afforded by the automatic filtration mechanism. Additional piping, pumps and controls are also required.

Another problem inherent in such filtration mechanism is the collection and disposal of spent filter medium segments. Handling such segments is often impractical or dangerous, due to the sometimes acidic nature of the process liquid.

Accordingly, the present invention has the following objectes:

To provide a system for continuously filtering electrochemical solutions;

To provide such systems in forms adaptable to the use of finely divided carbon particles as an additional filter material;

To provide such systems with automatic carbon handling and delivery rate features;

To provide such systems in forms utilizable with specially prepared roll-type filter media;

To provide such systems with automatic reel winding mechanisms to collect spent segments of filter medium;

To provide such systems with supports holding said filter medium in position to receive said additional filter material;

To provide such roll-type media in forms highly resistant to acidic solutions and high temperatures; and To provide such roll-type media in forms sufficiently strong to resist tearing when soaked with acidic solution.

These and further objects will become more apparent upon consideration of the accompanying drawings in which;

FIG. 1 is a front elevation of the inventive filtering system;

FIG. 2 is a top plan view illustrating delivery of carbon to the filter medium;

FIG. 3 is a partial side sectional view illustrating the filter chamber, door, and supply hopper;

FIG. 4 is a perspective view of the delivery chute;

FIG. 5 is a partial sectional view of the delivery chute;

Figure 6:
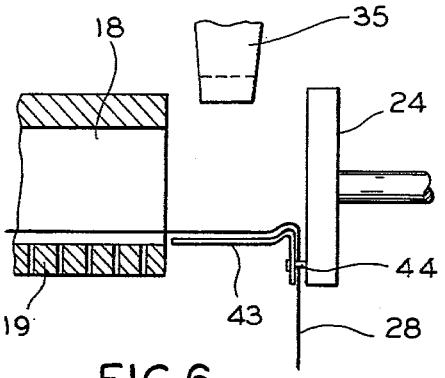
FIG. 6 is a partial side sectional view illustrating a filter medium support mounted to the door of the filter chamber.

Consistent with the foregoing objects, a continuous filtration system is provided wherein automatic filter mechanism 10 having filter chamber 15 is provided with filter medium 28 to effect mechanical filtration of process liquid 11, and vibratory delivery unit 33 is provided to deposit carbon onto filter medium 28 to effect chemical filtration. Carbon is deposited automatically and dispersed by delivery chute 35 into pattern 39 while filter medium 28 is being drawn into position in filter chamber 15. Support shelf 43 maintains filter medium 28 in position to receive carbon from delivery chute 35. Takeup reel assembly 45 collects spent filter medium segments as new segments are moved into filtering position.

Referring now to FIG. 1, the numeral 10 indicates generally an automatic continuous filtration mechanism used to filter acidic process liquid for nickel plating operations. Contaminated process liquid 11 is pumped from reactor vessel 12 via supply line 13 through supply pump 14 to filter chamber 15. After filtration, filtrate 16 is returned to tank 12 through return line 17.

In this embodiment, filter chamber 15 has an upper chamber 18 to receive contaminated process liquid 11, a perforated platen member 19 through which the filtrate passes, and a lower filtrate receiving chamber 20. Access to upper chamber 18 is controlled by intake valve 21, which in this embodiment is actuated by air solenoid system 22. Similarly, exit valve 23 may be similarly controlled and operated. Any conventional or well-known control system, enabling valves 21 and 23 to operate in a preselected sequence, may be utilized herein.

Access to upper chamber 18 is afforded by pneumatically operable chamber doors 24 and 25. Entry door 24 is operated by air cylinder and piston 26, while exit door 25 is operated by air cylinder and piston 27. Filtration occurs through filter medium 28, herein supplied in continuous roll form, as illustrated at 29. Filter medium 28 is drawn through upper chamber 18 to be positioned across platen 19 as will be described hereinbelow. Spent medium 28 may be wound onto takeup reel 30 of takeup assembly 45 positioned over bin 31, as will be set forth hereinbelow, and said spent medium may be further processed to reclaim any potentially valuable filtered material.

With filter medium 28 in position on platen 19, filtration continues for a predetermined length of time or until the buildup of particles on filter medium 28 requires a fresh portion of filter medium to be brought into position. At that point, fresh medium 28 is supplied in the following sequence: entry valve 21 is closed and, after upper chamber 18 has been emptied of solution, pump 14 is shut down, and exit valve 23 is closed. Air cylinders 26 and 27 are then actuated to draw doors 24 and 25, respectively, horizontally to open chamber 18 at each end. Power roller assembly 32 is then activated to draw filter medium 28 through upper chamber 18 until a fresh portion of filter medium has been moved into position. Air cylinders 26 and 27 are then activated to return doors 24 and 25 to their closed position thereby sealing off upper chamber 18, and valves 21 and 23 are then opened to allow the filtration process to continue. Spent filter medium 28 is collected on takeup reel 30 or in bin 31 for possible recycling and reclamation.

The embodiment herein discussed contemplates filtration of solutions used in nickel plating operations. Such solutions typically are highly acidic in nature and require filter media of sufficient acid resistance and strength to prevent the filter medium from tearing when the acid soaked medium is drawn forward by powered roller assembly 32. Such solutions are customarily maintained at elevated temperatures, as well. One material found to be of particular utility is manufactured by E. I. du Pont and is commercially obtainable from Eaton-Dike Corporation of Mount Holly Springs, Pa. under the trade mark Reemay.

Reemay is a polyester material, available to roll form and may be given additional strength as a filter medium by a process known as calendering wherein two or more plies of Reemay are heated then passed between heated rollers, bringing the plies into intimate contact and improving strength and permeability characteristics. One filter medium used successfully in combination with the described invention is known by the trade mark Koltex, and is manufactured and sold by Century Filter Products. As an example, a particular Koltex medium is produced by calendering two plies of Reemay at 400 degrees Farenheit at a roll pressure of 50 pounds per lineal inch. As many as four plies have been successively calendered, and it has been found that the permeability of the resulting formulation may be controlled by varing the speed at which the individual plies pass between the calender rollers, and the pressure exerted by the rollers on the individual plies. The resulting filter medium is then wound onto rolls for convenience in storage, shipping, and use.

As previously noted, filter material other than the filter medium is often required to assure chemical, as well as mechanical removal of impurities built up in the plating solution, thereby simultaneously filtering and purifying the solution. One such additional material found to bring excellent results is finely divided carbon. Past attempts at furnishing carbon as an additional filtering material have been concentrated on impregnating the filter medium with carbon, or preparing a carbon slurry to be combined with the flow of unfiltered solution. Neither approach has proven to be entirely satisfactory, because impregnation of filter medium with carbon is inherently expensive and increases material handling problems, and furnishing a carbon slurry requires additional pumping apparatus, piping, and storage tanks, and frequently requires the use of a recycle line containing unfiltered solution and slurry to maintain adequate filtration performance.

Choice of the technique used to supply carbon during the filtration process ia a critical one in terms of the overall efficiency of the filtration process. Typically, during plating operations without filtration units, a mass flow rate of ten thousand gallons per hour may be achieved. This rate drops to between six and eight thousand gallons per hour with use of a filter. However, when a side unit, such as a slurry tank is utilized, the effective flow rate may drop to between four and five thousand gallons per hour. Automatic filtration mechanisms such as that illustrated at 10 are intended to convert what was a substantially batch process into essentially a continuous process by minimizing interruptions required to filter the process liquid. The increased efficiency of such a mechanism is in large part destroyed when a side unit must be used to furnish carbon during filtration. Accurate delivery of a specified volume of carbon present difficult problems when a slurry tank is used. Changing the amount or type of carbon delivered to the plating solution involves either manually adding more carbon or more liquid to the slurry to change the concentration of carbon suspended therein, or maintaining manual or automatic adjustment of the flow rate of the carbon slurry from the supply tank to be combined with the reaction liquid. Varying the flow rate of slurry is a difficult and complex method for varying carbon concentration, because both the flow rate of solution and of slurry must be known or regulated in order to achieve a desired final concentration of carbon.

The present invention enables delivery of finely divided carbon to filter medium 28 at the point of filtration, and at selectively variable rates of delivery. This is accomplished, as illustrated in FIG. 1, through use of vibratory delivery unit 33.

Vibratory delivery unit 33 is attached to the supporting framework of filtration unit 10, and includes a storage hopper 34 within which finely divided carbon may be conveniently stored. The supply of carbon may thus be replenished or changed without interrupting the flow of process liquid.

Descending chute 34 is positioned to deliver carbon to delivery chute 35 when vibrator motors 36 and 37 are activated. For most efficient use, vibrator motors 36 and 37 are activated during that portion of the filtration cycle when a fresh portion of filter medium 28 is being moved into position on platen 19. The amount of carbon thus delivered may be selectively varied by varying the vibration rates of motors 36 and 37.

Delivery chute 35 has formed therewithin descending vanes 38 as illustrated in FIG. 5. Such vanes enable the carbon to be brought down the relatively narrow descending chute, yet be dispersed in a wide and accurately reproducible pattern as, for example, shown at 39 of FIG. 2.

Delivery chute 35 enables accurate placement of carbon on filter medium 28 as hereinbelow described and as best illustrated in FIG. 3. When it becomes necessary to advance filter medium 28 to position a fresh segment on platen 19, doors 24 and 25 are horizontally drawn by air valves 26 and 27. Door 24 has mounted thereon roller assembly 40 over which medium 28 is passed prior to its passage through upper chamber 18. As door 24 is drawn in direction A, medium 28 is similarly drawn to present a substantially horizontal portion 41, extending to a distance of about four inches. Delivery chute 35 is positioned to be directly above segment 41 when door 24 is in the "open" position. As filter medium 28 is drawn forward by power rollers 32 to position a fresh segment over platen 19, vibrators 36 and 37 are activated thereby delivering carbon through descending chute 34 to delivery chute 35. This results in a dispersed carbon pattern 39 on filter medium 28 as best illustrated in FIG. 2. Delivery of carbon then ceases and doors 24 and 25 may thereupon be closed and filtration may continue.

Figure 7:
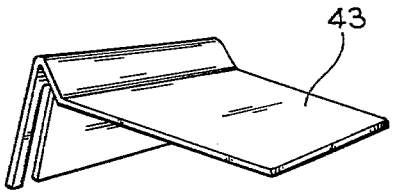
FIG. 7 is a perspective view of the support illustrated in FIG. 6.

As best seen in FIGS. 6 and 7, a second and more effective type of support for filter medium 28 may be formed as a support shelf 43, attached to door 24 and 25 in such a manner as to support filter medium 28 along its width while carbon is being deposited thereon, and still allowing door 24 to form a liquid tight seal with filter chamber 18 after carbon deposit has been completed. Support shelf 43 may be formed from stainless steel, or any suitable material chosen to minimize reaction between the shelf material and the process liquid.

Use of the invention as herein embodied may best be illustrated as follows. During normal filtration operations, unfiltered solution 11 passes via line 13 through pump 14 to filter chamber 15, thence passing through filter medium 28. Such filtration continues until the buildup of impurities trapped on filter medium 28 reaches a predetermined thickness. Solenoid-operated valve 21 is then closed to interrupt delivery of unfiltered solution to filter chamber 15. Concurrently, doors 24 and 25 are opened and filter medium 28 wound forward by roller assembly 32. Simultaneously, vibrator motors 36 and 37 of vibrator assembly 33 are activated, causing carbon to be delivered to filter medium 28 as it is being wound into position by power roller assembly 32, resulting in carbon dispersal pattern 39. Rate of delivery of carbon may be precisely controlled by adjusting the rates at which motors 36 and 37 vibrate, thus allowing the amount of filter material to be easily controlled to meet various filtration demands. During the time that power roller assembly 32 is advancing a fresh segment of filter medium 28 into filtering position, it is of course at that same time advancing a used segment of filter medium from filter chamber 18. Spent segments of filter medium 28 will typically have a substantial buildup of impurities and used additional filter material caked thereon, and such material will retain an appreciable amount of process liquid. This often presents material handling problems when it comes time to dispose of spent filter medium 28.

Figure 11:
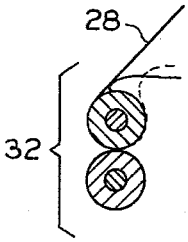
FIG. 11 is a partial side-sectional view of the rollers of FIG. 10.

Typically, in the past, rollers 32 have been allowed to draw spent segments of filter medium 28 to drop said segments into bin 31, for eventual disposal. Such a system has its inherent inefficiencies and inconveniences. One of the most serious occurs when the apparatus is shut down, as for the night. It is then not unusual for that segment of filter medium 28 maintained at roller assembly 32 to stick to said rollers. When the rollers are then activated the following day, the spent segments of filter medium 28 may tangle about rollers 32, rather than traveling through them, as shown at B of FIG. 11. When this occurs, knives must often be used in order to cut the filter medium from roller assembly 32. Such rollers are typically expensive, and such cutting will often damage rollers to the point where they must be replaced.

Figure 9:
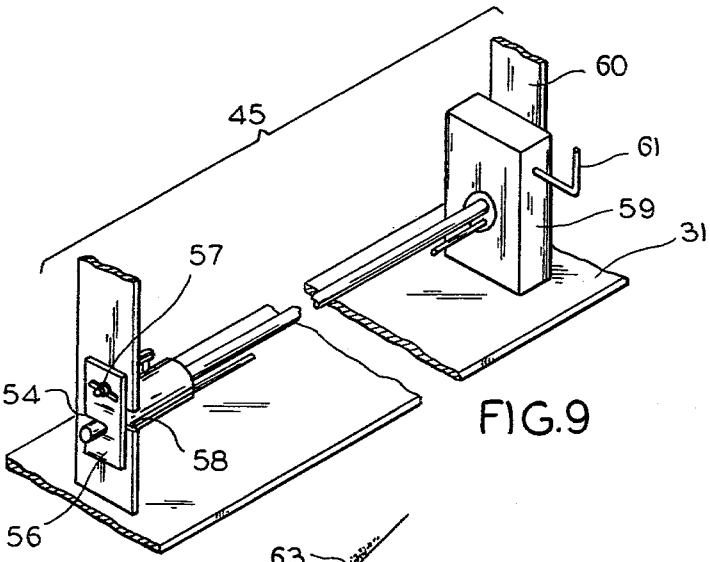
FIG. 9 is a partial perspective view of the takeup reel and takeup reel supports.
Figure 9A:
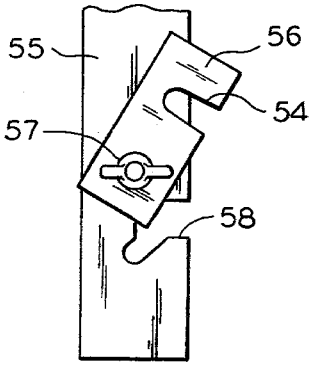
FIG. 9A is a detail showing the latch in FIG. 9 in a partially open position.

As best seen in FIG. 9, takeup reel assembly 45 is provided to wind spent segments of filter medium 28, enabling cleaner, more convenient collection and preventing jamming of filter medium 28 within power roller assembly 32.

Figure 8:
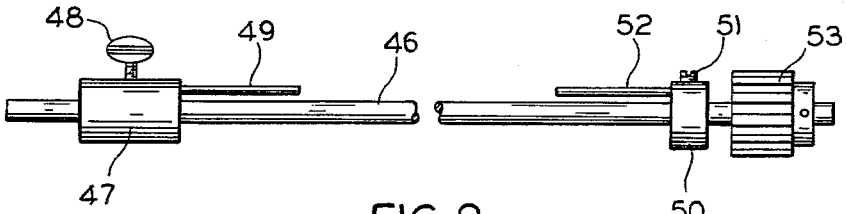
FIG. 8 is a side elevation of the takeup reel.

FIG. 8 illustrates the takeup spool, which in this embodiment is a stainless steel rod 46. At one end, rod 46 has collar 47 mounted slidebly thereon, and secured by thumb screw 48 to rod 46. Strut 49 extends from collar 47, and provides an initial anchoring point for filter medium 28 to begin the winding process. Similarly, a second collar 50, secured by set screw 51, and having strut 52 projecting therefrom may be removably positioned at the opposite end of rod 46. In this manner, collars 46 and 50 may be positioned on rod 46 to accommodate filter media of varying widths.

Drive gear 53 is affixed to rod 46 at one end thereof, and is used to turn rod 46 whenever reeling is required.

As best seen in FIG. 9, takeup assembly 45 further includes rod pivot 54, formed on support member 55 of apparatus 10. Latch plate 56 is secured by thumb screw 57, and may be pivoted as shown in FIG. 9 to close off slot 58 of pivot 54, or may be pivoted upward to enable rod 46 to be removed from pivot 54 via slot 58.

Reel assembly 45 is preferably powered to wind filter medium 28 independently of power rollers 32. In this manner, segments of medium 28 which have been pulled past drive rollers 32 will be less likely to "backfeed," or be drawn back toward and tangled in rollers 32, requiring time-consuming cleanup operations, or damage to costly power rollers. To drive rod 46, motor assembly 59, driven by compressed air, is preferably supplied and mounted to support member 60 of apparatus 10. A drive sprocket, now shown, may be mounted to air motor assembly 59 sized and shaped to mesh with drive gear 53. Compressed air may be supplied via air line 61 in order to drive motor assembly 59, as required.

As more spent medium is wound onto rod 46, fewer revolutions will be required to wind one length of medium 28 corresponding to a fresh filtering segment. Accordingly, the preferred motor assembly 59 is adjusted to drive rod 46 at the fastest speed anticipated to take up a segment of medium 28. When less speed is required, air motor assembly 59 can be "stalled" after fully winding a filter medium segment, without damage to the motor elements. When power roller assembly 32 is activated, filter medium 28 slackens between roller assembly 32 and takeup reel assembly 35; air motor assembly 59 then turns rod 46 to effect the winding of filter medium 28 onto rod 46.

Figure 10:
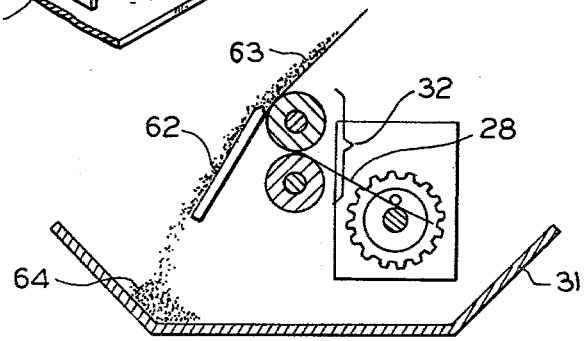
FIG. 10 is a partial side-sectional view along 10—10 of FIG. 9.

To make disposal of spent filter medium 28 even more convenient, scraper 62 may be provided, as shown in FIG. 10, to effectively scrape caked residue 63 from filter medium 28 before residue 63 passes through rollers 32. Residue thus removed may be collected in bin 31, as shown at 64.

When takeup reel assembly 45 has reached its capacity, or when filter medium 28 is changed, spent filter medium may be removed simply therefrom by loosening thumb screw 57 to pivot latch plate 54 upward, thereby enabling rod 46 to be removed from assembly 45 by withdrawing gear 53 from air motor assembly 59. Loosening thumb screw 48 enables collar 47 to be removed from rod 46, and thereby enables the roll of spent filter medium 28 to slide from beneath strut 52 and rod 46 for easy disposal.

When a fresh segment of filter medium 28 is wound in place, power to power roller assembly 32 and vibrator assembly 33 is interrupted. Doors 24 and 25 are then closed, locking filter medium 28 in place, and valves 21 and 23 are reopened to reestablish the flow of unfiltered solution. The flow of solution serves to distribute the carbon across the surface of medium 28 above platen 19.

To assure free operation of door 24, and to minimize the distance through which carbon must fall in order to reach filter medium 28, delivery chute 35 has channel 42 formed therein as shown in FIG. 4. This enables delivery chute 35 to be positioned a short distance above filter medium 28 when door 24 is in the open position, as shown in FIG. 3. During opening and closing, door 24 passes partially through channel 42. Similarly, roller 40 or shelf 43 is positioned on door 24 at a height sufficient to enable door 24 to be tightly closed against filter chamber 15. Thus, in the closed position, roller 40, or shelf 43 is positioned within upper chamber 18 to maximize the fluid-tight character of the seal formed between upper chamber 18 and door 24.

Thus, filter medium 28 provides a mechanical means of filtration while carbon, supplied by vibrator unit 33 acts as a chemically active filtering and purifying agent. By altering the formulation of filter medium 28 and by selecting the rate at which carbon is deposited on filter medium 28 the user has a wide range within which to adapt an automatic continuous filtering apparatus to a variety of uses and requirements.

In this manner, continuous filtration may be carried on with a minimum of interruption to the actual plating operations. Should filtration of various plating solutions require varying concentrations of carbon, the rate of delivery of vibrator unit 33 may easily be reset. Such control over the rate of carbon delivered makes it possible, in most cases, to use a single type of filter medium for filtration; however, should a different filter medium be required, a simple change of filter medium rolls is all that is necessary. Use of the present invention therefore helps to minimize the inventory of filter media and materials required for a variety of filtration purposes.

Different processes, utilizing different solutions, may require carbon of a different degree of granulation. Supplying new carbon through supply hopper 34 may be accomplished without interrupting the filtration process.

Circuitry and automatic control systems to effectuate activation of vibrator unit 33 concurrent with the winding into position of fresh filter medium 28 may be utilized in a variety of well known methods using components and techniques well known in the art, making it unnecessary to detail any such system herein.

Various formulations of Reemay have been tested, and satisfactory results have been obtained with an end product having a weight ranging from 2.0 to 2.4 ounces per square yard. Calendering has been satisfactorily carried out at a temperature of 400 degrees Fahrenheit and a roller pressure of 50 lbs./lineal inch. It has been found that use of Koltex filter medium together with the carbon delivery system detailed herein, provides a filtration system of wide range and flexibility, capable of handling most commonly encountered filtration requirements for electrochemical solutions, while avoiding the necessity for large inventories of filter media and frequent changes of media during filtration.

While the foregoing has presented a specific embodiment of the invention described herein, it is to be understood that this description is offered by way of example only. It is expected that that others skilled in the art may perceive variations which, while differing from the foregoing, do not depart from the spirit and scope of the invention.

I claim:

1. In combination with automatic filtration apparatus of the type having a filter chamber through which continuous filter medium may be intermittently drawn, and an entry door selectively openable and closeable to enable ingress of said filter medium to said filter chamber, wherein said filter medium may be linearly advanced by powered rollers into said filter chamber to bring fresh segments of said filter medium into filtering position, while moving used segments of said filter medium out of filtering position, the improvement comprising:

means to collect used segments of said filter medium onto a reel mechanism;

said collecting means including a reel shaft, said shaft having a first end and a second end, said first end having a first collar positioned proximate thereto, first means to slidably position said first collar along said reel shaft and to secure said first collar at a selected point therealong, said second end having a second collar positioned proximate thereto, second means to slidably position said second collar at a selected point therealong;

said first and second positioning means having means thereon to contact said filter medium; and means to rotatably drive said reel shaft, whereby said filter medium is drawn by said contacting means to be wound onto said reel shaft.

2. The apparatus as recited in claim 1 wherein said driving means includes:

a motor driven by compressed air; and means to connect said reel shaft to said motor.

3. The apparatus as recited in claim 2 wherein said shaft connecting means includes a drive gear mounted to said motor, and a driven gear mounted to one end of said reel shaft.

4. The apparatus as recited in claim 2 wherein said motor drives said reel shaft to tension said used segments to keep said segments taut when being wound onto said reel shaft while said filter medium is linearly advanced by said powered rollers.

* * * * *